United States Patent [19]

Brabson

[11] 4,059,755

[45] Nov. 22, 1977

[54] LUMINAIRE LENS INSERT

[75] Inventor: Grafton K. Brabson, Quarryville, Pa.

[73] Assignee: Armstrong Cork Company, Lancaster, Pa.

[21] Appl. No.: 644,754

[22] Filed: Dec. 29, 1975

[51] Int. Cl.[2] ..... F21V 5/04

[52] U.S. Cl. ..... 362/224; 362/330

[58] Field of Search ..... 240/73 LD, 78 LD, 92, 240/93, 106 R, 106.1

[56] References Cited

U.S. PATENT DOCUMENTS

| | | | |
|---|---|---|---|
| 1,472,639 | 10/1923 | Dorey | 240/93 |
| 2,394,992 | 2/1946 | Franck | 240/93 |
| 2,474,317 | 6/1949 | McPhail | 240/106 R |
| 3,009,054 | 11/1961 | Thomas | 240/51.11 R |
| 3,154,254 | 10/1964 | McPhail et al. | 240/106 R |
| 3,159,352 | 12/1964 | Wakefield et al. | 240/106 R X |
| 3,234,376 | 2/1966 | Ceglia | 240/106 R |
| 3,291,979 | 12/1966 | Logan | 240/78 LD |
| 3,647,148 | 3/1972 | Wince | 240/93 |
| 3,725,697 | 4/1973 | Wince | 240/93 |

*Primary Examiner*—Fred L. Braun

[57] ABSTRACT

A luminaire lens is provided with a prism arrangement which emits light in two beams. A fluorescent tube fixture is utilized with the lens and approximately the same amount of light comes from the 0° to 30° zone of candlepower distribution and the 30° to 60° zone of candlepower distribution, with very little light emitted from the 60° to 90° zone of candlepower distribution. A second lens insert element is provided within the primary luminaire lens to mask the image of the fluorescent tube.

2 Claims, 3 Drawing Figures

LUMINAIRE LENS INSERT

CROSS-REFERENCE TO RELATED APPLICATION

This application is an improvement over U.S. application Ser. No. 644,753, filed Dec. 29, 1975 in the name of Grafton K. Brabson and entitled "TWIN-BEAM LUMINAIRE LENS".

BACKGROUND OF THE INVENTION

1. Field of the Invention

The invention is directed to illumination and, more particularly, to a combination lens structure for distributing light from a light fixture in a certain predetermined pattern.

2. Description of the Prior Art

U.S. Pat. No. 3,647,148 is directed to a patent for a luminaire lens that distributes light in a very definite two-beam pattern arrangement as seen in FIG. 7 of that patent.

U.S. Pat. No. 2,394,992 is directed to another luminaire lens in which light is directed in a very definite two-beam pattern arrangement (see FIG. 3). In the prior art, there are many different ways of distributing light from a light fixture. The above-mentioned U.S. patents distribute light in a very definite two-beam pattern arrangement with very little light distributed in the 0° to 30° zone of candlepower distribution and the 60° to 90° zone of candlepower distribution.

U.S. Pat. No. 3,725,697 is directed to a luminaire structure involving a secondary lens insert for diffusing and distributing light from a high intensity light source into the luminaire primary lens.

U.S. Pat. No. 3,291,979 is directed to a luminaire wherein a secondary lens is used behind the primary lens of the luminaire.

Finally, U.S. Pat. No. 3,234,376 is directed to a luminaire wherein plural lens structures are utilized for the lens assembly of the luminaire.

SUMMARY OF THE INVENTION

A luminaire lens is used with a twin-beam type of candlepower distribution to provide greater effective illumination. The lens has a large amount of light emitting from angles other than nadir. Most of the light rays are emitted at angles ranging from 20° from nadir to 45° from nadir. Due to the prism shape and arrangement in the bottom of the luminaire lens and the two sides of the luminaire lens, the candlepower distribution is such that the amount of light coming from the 0° to 30° zone of candlepower distribution is about equal to the light coming from the 30° to 60° zone and there is very little light emitted from the 60° to 90° zone. The luminaire lens is used with a single or plural lamp (fluorescent tube) fixture and provides increased effective illumination with a reduction in illumination in the nadir direction and in generally horizontal angles from the light fixture.

A lens insert is placed behind the primary luminaire lens and in front of the lamp or lamps of the fixture to eliminate the objectionable image of the lamp or lamps when the luminaire is viewed from certain angles.

DESCRIPTION OF THE PREFERRED EMBODIMENT

Figure 1:
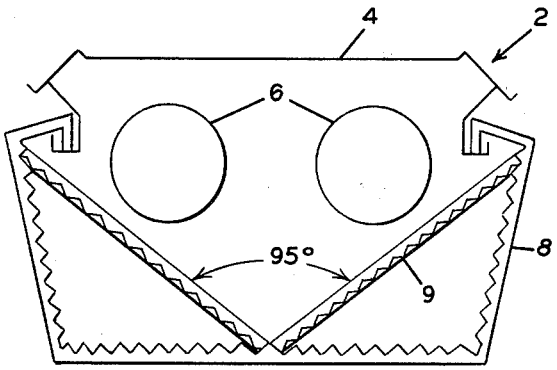
FIG. 1 is a cross section of a luminaire having the preferred tube and lens arrangement.

The structure of the luminaire having the inventive lens herein is shown in FIG. 1. A normal luminaire will cast light straight down and in such a manner that the greatest candlepower is distributed over the surface below the luminaire. This, of course, means that inasmuch as the shortest distance from the luminaire to the work is along the nadir, the vertical line from the center of the luminaire, the largest amount of light is concentrated directly below the light and spreads as widely as possible from the nadir to cover the maximum area most sufficiently. Recently, luminaires have been developed, such as that in U.S. Pat. No. 3,647,148, wherein virtually no light is distributed in the direction of the nadir and the concentration of light is emitted at lateral angles on either side of the nadir. That patent substantially eliminates light rays from the 0° to 30° angular range from the nadir and directs substantially all the light within the angular range of 30° to approximately 60° on either side of the nadir.

The lens of FIG. 1 differs from both prior art distributions by providing a candlepower distribution such as that shown in FIG. 3, to be discussed below. The light fixture or luminaire 2 is composed of a housing 4 which contains two fluorescent tubes or lamps 6. It is possible to use a luminaire 2 which contains only one fluorescent tube 6. A three-sided primary lens 8 is placed over the fluorescent tube(s) of the light fixture. The inside of the lens has a prism arrangement which will refract light to form the candlepower distribution curve of FIG. 3. Within the lens 8 there is placed a secondary lens 9 which is generally V-shaped. This lens 9 is used to break up the tube image of the light source and to improve the angles at which the light rays strike the prisms of the main lens 8. The lenses may be made of conventional glass or plastic material such as are normally used in the art.

Figure 3:
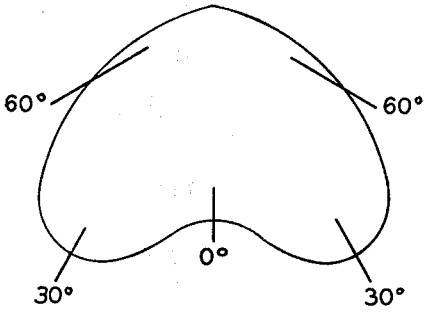
FIG. 3 is a light distribution diagram illustrating the transverse distribution of light from the luminaire shown in FIG. 2.
Figure 2:
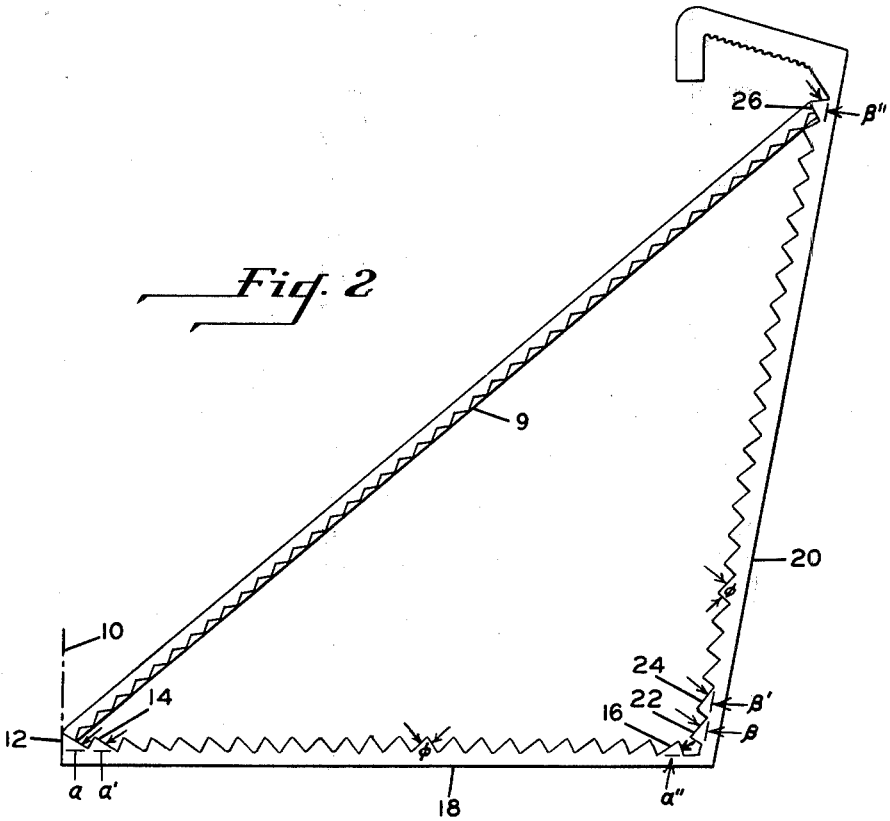
FIG. 2 is an enlarged cross-sectional view of a portion of the lens structure.

Referring now to FIG. 2, there is shown the prism arrangement on the bottom and sides of the lens 8 and the insert lens 9 which yield the desired candlepower distribution curve of FIG. 3. Line 10 represents the center line of the lens, or the nadir line. The prisms of the main lens 8 are made approximately ⅛ inch wide and the alpha angle of the first prism 12 is a 30° included angle. The next adjacent prism 14 has a width or base of approximately ⅛ inch and its alpha prime angle is 32°. The prisms, as they extend across the lens bottom 18 from the center to the edge thereof, increase their alpha angles by 2° with each prism until the last prism 16 is reached. At this time, the alpha double prism angle is 74°. This showing in FIG. 2 represents one-half of the bottom 18 of the lens. The same type of distribution is provided on the opposite side of the lens with the alpha angles of the prisms therein all facing towards the center of the lens and all increasing from 30° to 74° by 2° increments. The primary lens 8 also has two sides 20 which are inclined at an angle from a line perpendicular to the plane of the bottom 18 of the lens to provide an included angle of 100° between the bottom and side. Along the sides 20 there is arranged a series of prisms. The prisms have a width of ⅛ inch. The first prism 22 has a beta angle of 35°. The next prism 24 has a beta prime angle of 36°. The prisms, as they extend along the side of the lens from the bottom of the lens to the top of the lens, have the beta angles increased by one degree until the last prism 26 is reached, wherein the beta double prime angle is 57°. The prisms are all made with an omega angle of 78°. The omega angle is the included angle at the peak of the prisms and the prisms are all linear prisms.

The main lens 8 is then supplemented with an insert lens 9 which is placed within the main lens 8 between the main lens 8 and the light tube or tubes 6. The lens insert 9 is generally V-shaped with a 95° included angle, as shown in FIG. 1. The point of the V rests upon the center of the bottom of the main lens 8 and the two sides of the V extend upwardly to the upper end of each side of the main lens 8. As shown in FIG. 2, the lens insert 9 extends from prism 12 on the bottom 18 of lens 8 to prism 26 on the side of lens 8. The lens insert is provided with a prismatic pattern which is placed on the side of the insert facing away from the tubes 6. The prisms of the insert are prismatic and are approximately 0.188 inches square at their base, 0.060 inches high, and are made with base angles of 33° and a prism peak angle of 114°. This construction for the lens 8 and the insert 9 will provide the candlepower distribution curve of FIG. 3.

The curve of FIG. 3 is a polar diagram illustrating the candlepower distribution, taken in a transverse direction, of a longitudinal luminaire provided with the lens and lens insert of the present invention. It will be seen that there is some distribution of light in the nadir direction which is directly perpendicular from the face of the lower plane of the luminaire. It will be seen that maximum light distribution is to either side of the nadir in the region of an angle from 20° to 45° from the nadir. As was indicated above, the lens insert system could be used in a light fixture having one lamp or two lamps.

If a one lamp fixture is utilized, approximately 48% of the illumination on one side of the nadir appears in the area from 0° to 30° from the nadir. Another 44% of the illumination appears in the area from 30° to 60° from the nadir. Only approximately 8% of the illumination appears in the area from 60° to 90° from the nadir. If a two lamp fixture is utilized, then approximately 50% of the illumination on one side of the nadir appears in the area from 0° to 30° from the nadir. Another 41% of the illumination appears in the area from 30° to 60° from the nadir. Only approximately 9% of the illumination appears in the area from 60° to 90° from the nadir.

What is claimed is:

1. An elongated luminaire for illuminating an area therebelow comprising a linear light source, an elongated primary prism having a bottom section formed with a series of parallel prisms extending from the center of the bottom section of the luminaire to the edge of the luminaire, said prisms having an included angle fixed in size and an included angle which increases in size as one progresses from the centermost prism to the edgemost prism of the bottom section, said prisms being formed on the sides thereof facing the light source, said prisms constituting light incident and light emergent surfaces for redirecting and emitting light rays from the light source generally away from a vertical plane passing through the axis of the linear light source and into annular ranges on either side thereof, and a lens insert means between the light source and the primary prism, said lens insert having prisms on the side thereof facing away from the light source, the distribution of light from both the primary prism and lens insert being such that substantially half of the light distribution will emit in an area of 0° to 30° from the vertical plane and substantially the other half of the light is distributed in an area from 30° to 60° from the vertical plane, and the light actually is distributed in two zones either side of the vertical plane.

2. An elongated luminaire for illuminating an area therebelow comprising a linear light source, an elongated primary prism having a bottom section and two side sections on either side of the bottom section, said bottom section of the luminaire is formed with a series of parallel prisms extending from the center of the bottom section of the luminaire to the edge of the luminaire, said prisms having an included angle fixed in size and an included angle which increases in size as one progresses from the centermost prism to the edgemost prism of the bottom section, the sides of the luminaire have a plurality of parallel prisms which extend from adjacent the bottom section to adjacent the top of the side section and said prisms have a fixed size included angle and an included angle which increases in size as one moves from adjacent the bottom section to adjacent the top of the side section, said sections having prisms formed on the sides thereof facing the light source, said prisms constituting light incident and light emergent surfaces for redirecting and emitting light rays from the light source generally away from a vertical plane passing through the axis of the linear light source and into annular ranges on either side thereof, and a lens insert means between the light source and the primary prism, said lens insert having prisms on the side thereof facing away from the light source, the distribution of light from both the primary prism and lens insert being such that substantially half of the light distribution will emit in an area of 0° to 30° from the vertical plane and substantially the other half of the light is distributed in an area from 30° to 60° from the vertical plane, and the light actually is distributed in two zones either side of the vertical plane.

* * * * *